United States Patent [19]

Warncke

[11] 4,178,961

[45] Dec. 18, 1979

[54] LUNG-CONTROLLED MEMBRANE VALVE FOR COMPRESSED GAS RESPIRATORS

[75] Inventor: Ernst Warncke, Lübeck, Fed. Rep. of Germany

[73] Assignee: Drägerwerk Aktiengesellschaft, Fed. Rep. of Germany

[21] Appl. No.: 840,961

[22] Filed: Oct. 11, 1977

[30] Foreign Application Priority Data

Oct. 14, 1976 [DE] Fed. Rep. of Germany ..... 2646338

[51] Int. Cl.[2] ..... A62B 7/04

[52] U.S. Cl. ..... 137/495; 128/204.26; 137/DIG. 9

[58] Field of Search ..... 128/142.2; 137/495, 137/DIG. 9; 251/14

[56] References Cited

U.S. PATENT DOCUMENTS

| | | | |
|---|---|---|---|
| 1,148,568 | 8/1915 | Bees | 137/495 X |
| 2,758,596 | 8/1956 | Cupp | 128/142.2 |
| 3,768,466 | 10/1973 | Johnson | 128/142.2 |

FOREIGN PATENT DOCUMENTS

| | | | |
|---|---|---|---|
| 959620 | 3/1957 | Fed. Rep. of Germany | 137/DIG. 9 |

*Primary Examiner*—Robert G. Nilson

*Attorney, Agent, or Firm*—McGlew and Tuttle

[57] ABSTRACT

A lung-controlled valve for compressed gas respirators comprises a valve housing having a diaphragm chamber with a diaphragm extending across the chamber and being displaceable backwardly and forwardly in the chamber by pressure changes on respective sides thereof. A connecting piece for supplying breathing gas to a patient is connected into the chamber on one side of the diaphragm and the patient's breathing pressure controls the operation of the diaphragm. A valve member having a valve chamber with a pressure gas inlet has a valve seat in the chamber with a valve opening into one side of the diaphragm chamber. A valve body closing the valve seat and shutting off the pressure gas flow into the chamber has a tippling lever connected thereto and disposed in the one diaphragm chamber adjacent the diaphragm in a position to be contacted during movement thereof to open the valve. A hand operated lift off member is mounted in the valve housing for displacement into engagement with the valve to lift it off the valve seat and to open the valve passage when a temporary supply of pressure gas is necessary for the system. The lift off member is advantageously biased by a spring member backwardly into a non-operative position.

4 Claims, 2 Drawing Figures

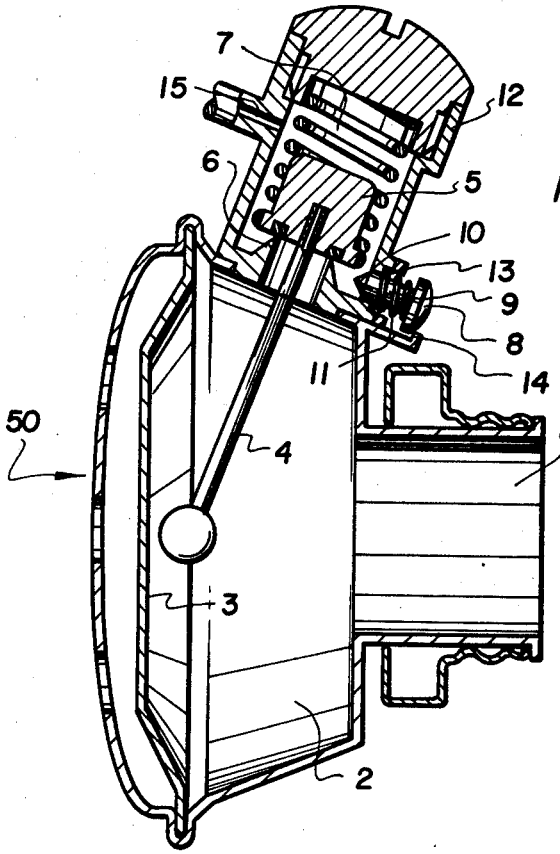
FIG. 1
FIG. 2
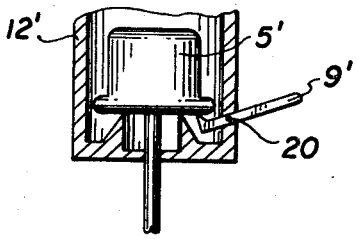

LUNG-CONTROLLED MEMBRANE VALVE FOR COMPRESSED GAS RESPIRATORS

BACKGROUND OF THE INVENTION

1. Field of the Invention

The invention relates in general to respirators and in particular to a new and useful lung-controlled membrane valve for compressed gas respirators with a bushbutton for actuating the valve.

2. Description of the Prior Art

In lung-controlled membrane valves for compressed gas respirators, means are usually supplied which permit manual actuation for opening and closing the normally lung-controlled valves. It is to be assured thereby that the respirator wearer can be supplied with respiratory air also when the negative pressure (vacuum) required for actuation—which is supplied by the pulmonary force—is no longer sufficient. This may be the case, for example, when the membrane seizes or the mechanical transmission system is damaged.

All known devices have the disadvantage that the air supply after manual actuation depends on the mechanical ability of the valve to function.

A known lung-controlled membrane valve for compressed gas respirators is fitted, at a rubber or plastic covering with which the membrane-protecting cover is covered, with a push button for actuation of the membrane. Said pushbutton is provided with a snap button type projection toward the membrane and traversing the membrane-protecting cover. In the inoperative state, the projection does not touch the membrane. When depressing the pushbutton, the projection is pressed against the member and flexes it to the extent that the control lever contiguous to it is actuated and the lung-controlled valve is opened. It is thereby possible to supply the respirator wearer with air when the automatic supply fails, e.g. due to jamming of the membrane or of the lever system. A disadvantage of this arrangement is the necessity that the valve including the transfer from the membrane to the actual valve must be operable. Should the control lever be broken or the closing stud blocked, actuation of the membrane by means of the pushbutton cannot open the valve (German Patent No. 1 080 404).

A further known oxygen respirator has, in addition to a flushing device, a lung-controlled oxygen supply valve, which can be opened by finger pressure, so that oxygen can enter the respiratory cycle from the oxygen bottle independently of the pressure from respiration. The oxygen supply valve is a membrane valve. Between the protective cover and the membrane, a leaf spring under tension is arranged, which can assume a position arched outwardly toward the protective cover or inwardly toward the membrane. In the arched inwardly state, it maintains the oxygen supply valve open by pressure on the membrane and a control lever. The protective cover has a central opening, through which, when taking into operation, e.g. by actuation with the finger, the leaf spring is pressed inward and thereby the valve is opened. After the intended pressure has been reached, the leaf spring is pushed into its inoperative position by the membrane. The lung-controlled membrane valve then operates normally. What is disadvantageous is that oxygen supply is not assured if the control lever or other elements of the lever linkage should break or jam, because the possibility of control via the leaf spring presupposes a functioning valve arrangement. (German Patent No. 1 257 585).

SUMMARY OF THE INVENTION

The invention provides for the opening and closing of the membrane valve by manual actuation independent of faults and defects in the control and transmission system.

According to the invention, a movable, sealing lift-off element is passed through the wall of the housing and engages by its butt end under the sealing end wall of the closing valve.

The advantages attained with the invention consist in particular in that the butt end of the lift-off element engages directly at the end wall of the closing stud or valve and that upon further movement of the lift-off element the valve lifts off the valve seat, thereby opening the valve. Opening, therefore, occurs directly at the crucial closing valve. There are no other elements for transmitting the opening force. Blocking of the operation or damage to the structural parts normally opening and closing the valve as a function of the respiratory pressure cannot prevent the manual opening, which is done especially in emergency situations. Besides, the device can be manufactured in a design which is simple and reliable.

In a variant of the invention, the lift-off element is a spring-loaded stud, axially displaceable, with the pushbutton and the butt end in conical form. The butt end may also be formed by an inclined plane. With these realizations the advantages of the simple manufacture and reliable operation become even more evident.

As a further variant, the lift-off element is the loadlifting lever of an angle lever mounted rotatable.

The angle lever provides that under special conditions, with respect to the possible direction of actuation, the pressure on the pushbutton can in a simple manner become a pull for emergency opening of the valve.

Accordingly it is an object of the invention to provide a lung-controlled valve for compressed gas respirators which includes a diaphragm movable in a diaphragm chamber which is connected on one side to the patient and which includes a connection to a compressed gas through a valve member having a valve seat with an opening closed by a valve which has a tipping lever extending through the opening into a position in which it is contacted by the diaphragm during its flexing movement and which further includes a lift-off member which is movable into engagement with the valve to lift it off its seat to open the valve for the flow of pressure gas thereinto.

A further object of the invention is to provide a lung-controlled valve for compressed gas respirators which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the Drawings:

FIG. 1 is a transverse sectional view of a lung controlled valve for compressed gas respirators constructed in accordance with the invention; and FIG. 2 is a partial view similar to FIG. 1 indicating another embodiment of the invention.

GENERAL DESCRIPTION OF PREFERRED EMBODIMENTS

Referring to the drawings in particular, the invention embodied therein comprises a lung-controlled valve generally designated 50 for compressed gas respirators which has a vacuum chamber or diaphragm chamber 2 which is connectable to a connecting piece 1 of a respirator for a patient and it includes a diahragm 3 which is displaceable in the chamber 2 in accordance with the patient's breathing pressures to engage a tipping lever 4 of a valve or stud 5 of a valve member or housing 12. The housing 12 is connected through a pressure line 15 to a pressure gas such as oxygen.

The membrane valve 50 is connected with the inlet of a mask or a wearer's mouthpiece via the connecting piece 1. During inhalation, a vacuum which moves membrane 3 toward the tipping lever 4 is created in the membrane chamber 2. By the movement of the tipping lever 4 the closing stud or valve 5 is lifted off the valve seat 6 unilaterally, so that expanding compressed air flows through the medium-pressure chamber 7, out of the medium-pressure line 15 leading to this chamber and into the membrane chamber 2 and the connection 1 to the inlet via the valve seat 6.

If there has been, for example, a failure of the tipping lever 4 or a jamming of the closing stud 5, the wearer can lift the closing stud 5 off the valve seat again in a tipping movement by pressure on the pushbutton 8 of a lift-off element 9. At its butt end 10 the lift-off element 9 has the form of a cone which, upon axial inward displacement, lifts the closing stud 5 unilaterally. A spring 11 causes the lift-off element 9 to return to the starting position after actuation. Thus this pushbutton arrangement can also be used at all times to bring about an air douche.

In the housing 12, the lift-off element 9 is sealed by a seal 13. A stop 14 is provided, which establishes the end position of the pushbutton 8 so that it cannot be pushed out of the seal 13 by the spring 11.

In FIG. 2 instead of the lift-off element 9, the device is provided with a lever-type lift-off element 9' which is pivotally mounted at 20 on the housing 12 and is operable in a slot of the housing so that the exterior portion of the lever 9' may be pressed downwardly to lift the closing stud 5' upwardly against the force of a spring acting thereon which is similar to that of the first embodiment.

While specific embodiments of the invention have been shown and described in detail to illustrate the application of the principles of the invention, it will be understood that the invention may be embodied otherwise without departing from such principles.

What is claimed is:

1. A lung controlled valve for compressed gas respirators, comprising a valve housing having a diaphragm chamber, a diaphragm extending across said chamber and being displaceable by pressure changes therein, a connecting piece for supplying breathing gas connected into said chamber on one side of said diaphragm, a valve member having a valve chamber with a pressure gas inlet, a valve seat in said valve chamber with an opening therein from said valve chamber to one side of said diaphragm chamber, a valve body enclosing said valve seat and shutting off the pressure gas flow into said one side of said diaphragm chamber, a tipping lever connected to said valve and extending through said valve opening into said one side of said diaphragm chamber in a position to be contacted by said diaphragm during displacement thereof to raise said valve and open said valve opening, a hand-operated lift off member mounted in said valve member for displacement into engagement with said valve body to lift it off said seat, including spring means biasing said valve to a closed position, said lift-off member comprising a push button having a conical end engageable with said valve body.

2. A lung-controlled valve according to claim 1, including spring means biasing said lift-off member in a direction away from said valve.

3. A lung-controlled valve for compressed gas respirators, comprising a valve housing having a diaphragm chamber, a diaphragm extending across said chamber and being displaceable by pressure changes therein, a connecting piece for supplying breathing gas connected into said chamber on one side of said diaphragm, a valve member having a valve chamber with a pressure gas inlet, a valve seat in said valve chamber with an opening therein from said valve chamber to one side of said diaphragm chamber, a tipping lever connected to said valve and extending through said valve opening into said one side of said diaphragm chamber in a position to be contacted by said diaphragm during displacement thereof to raise said valve and open said valve opening, a hand-operated lift-off member mounted in said valve member for displacement into engagement with said valve body to lift it off said seat, said lift-off member comprising a pushbutton having a shank portion with an inclined end wedgable against said valve body.

4. A lung-controlled valve for compressed gas respirators, comprising a valve housing having a diaphragm chamber, a diahragm extending across said chamber and being displaceable by pressure changes therein, a connecting piece for supplying breathing gas connected into said chamber on one side of said diaphragm, a valve member having a valve chamber with a pressure gas inlet, a valve seat in said valve chamber with an opening therein from said valve chamber to one side of said diaphragm chamber, a valve body enclosing said valve seat and shutting off the pressure gas flow into said one side of said diahragm chamber, a tipping lever connected to said valve and extending through said valve opening into said one side of said diaphragm chamber in a position to be contacted by said diaphragm during displacement thereof to raise said valve and open said valve opening, a hand-operated lift-off member mounted in said valve member for displacement into engagement with said valve body to lift it off said seat, said lift-off member comprising a lever rotatably mounted in said valve body.

* * * * *